US009025992B2

(12) United States Patent
Shin

(10) Patent No.: US 9,025,992 B2
(45) Date of Patent: May 5, 2015

(54) SHEET FEEDING DEVICE AND IMAGE FORMING DEVICE PROVIDED WITH SAME

(71) Applicant: KYOCERA Document Solutions Inc., Osaka (JP)

(72) Inventor: Koji Shin, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/311,199

(22) Filed: Jun. 20, 2014

(65) Prior Publication Data

US 2015/0003860 A1 Jan. 1, 2015

(30) Foreign Application Priority Data

Jun. 27, 2013 (JP) ..... 2013-135158

(51) Int. Cl.

| | |
|---|---|
| ***G03G 21/00*** | (2006.01) |
| ***G03G 21/16*** | (2006.01) |
| ***G03G 15/00*** | (2006.01) |
| *G03G 15/23* | (2006.01) |

(52) U.S. Cl.

CPC ..... *G03G 21/1638* (2013.01); *G03G 15/234* (2013.01); *G03G 15/6529* (2013.01); *G03G 2215/00544* (2013.01); *G03G 2215/0132* (2013.01)

(58) Field of Classification Search

CPC ..... G03G 15/234; G03G 15/6529; G03G 21/1638; G03G 2215/00544; G03G 2215/0132

USPC ..... 399/21, 68, 98, 107, 110, 124, 388

See application file for complete search history.

(56) References Cited

U.S. PATENT DOCUMENTS

| | | | | |
|---|---|---|---|---|
| 2005/0189700 | A1* | 9/2005 | Uchida | 271/147 |
| 2006/0083543 | A1* | 4/2006 | Sunohara | 399/110 |
| 2011/0001284 | A1* | 1/2011 | Ohtsuki | 271/162 |
| 2011/0156346 | A1* | 6/2011 | Chen | 271/264 |
| 2013/0256970 | A1* | 10/2013 | Nguyen et al. | 271/3.14 |

FOREIGN PATENT DOCUMENTS

| | | | |
|---|---|---|---|
| JP | 7-210044 | A | 8/1995 |
| JP | 07210044 | A * | 8/1995 |

* cited by examiner

*Primary Examiner* — Francis Gray

(74) *Attorney, Agent, or Firm* — Stein IP, LLC

(57) ABSTRACT

This sheet feeding device is provided with a fixed frame having a first feed roller, and a turning frame which, through rotation from a closed position to an open position, exposes a sheet feed path. The turning frame includes: a second feed roller with an integrally rotatable feed gear which forms a nip together with the first feed roller; a cleaning member configured to wipe the second feed roller; and a transmission gear. The fixed frame includes a fixed gear for engaging the transmission gear. The transmission gear, through turning of the turning frame to the open position, engages the feed gear, and rotates the second feed roller.

10 Claims, 9 Drawing Sheets

SHEET FEEDING DEVICE AND IMAGE FORMING DEVICE PROVIDED WITH SAME

CROSS-REFERENCE TO RELATED APPLICATIONS

This application is based upon and claims the benefit of priority from the corresponding Japanese Patent Application No. 2013-135158, filed Jun. 27, 2013, the entire contents of which are incorporated herein by reference.

BACKGROUND OF THE INVENTION

The present disclosure relates to a sheet feeding device for feeding sheets, such as paper onto which images are to be printed; and to an image forming device provided with the same.

Sheet feeding devices for feeding paper (sheets) are incorporated into image forming devices that print images onto paper for output. In such an image forming device, feed rollers are situated along a paper feed path, and the paper is fed by rotating the feed rollers.

The feed rollers contact the paper to feed the paper through frictional force exerted against the paper. At this time, paper dust may be produced as the paper is abraded by the feed rollers, the paper dust becoming deposited on the feed roller. Moreover, due to abrasion of the paper feed path and the paper during paper feed, paper dust is produced at that time as well, and becomes deposited on the feed roller. According, various techniques for cleaning feed rollers have been proposed to date. For example, in the prior art, a cleaning member composed of a sponge was abutted against the feed roller. In so doing, paper dust deposited on the feed roller is scraped off by the cleaning member as the feed roller rotates during paper feed.

When the cleaning member is abutted against the feed roller, paper dust gradually accumulates in the abutting section of the feed roller and the cleaning member. As the paper dust accumulates, the paper dust becomes packed into a clump. Clumps of paper dust sometimes slip through the abutting section of the feed roller and the cleaning member and are transferred to the fed paper, becoming fed together with the paper. In such cases, clumps of paper dust may become deposited on the photosensitive drums, on the transfer rollers, or the like, giving rise to diminished image quality. For this reason, paper dust accumulating in the abutting section of the feed roller and the cleaning member must be removed.

SUMMARY OF THE INVENTION

The sheet feeding device according to a first aspect of the present disclosure is provided with a fixed frame and a turning frame. The fixed frame has a drive section and a first feed roller. The turning frame is supported in opening/closing fashion at one end thereof as a turning fulcrum by the fixed frame; and at the closed position forms a sheet feed path in association with the fixed frame, the turning frame exposes the inside of the sheet feed path by turning thereof from the closed position to an open position. The turning frame includes a second feed roller with an integrally rotatable feed gear, a cleaning member, and a transmission gear. The second feed roller at the closed position forms a nip together with the first feed roller, and rotates to feed a sheet. The cleaning member wipes the peripheral surface of the second feed roller. The rotatably supported transmission gear is capable of engaging and disengaging the feed gear. The fixed frame includes a fixed gear. The fixed gear is fixed to the fixed frame, and through turning of the turning frame from the closed position to the open position engages the transmission gear and rotates the transmission gear. The transmission gear disengages from the feed gear when the turning frame is at the closed position; and through turning of the turning frame from the closed position to the open position engages the feed gear, rotating the second feed roller in the opposite direction from that during sheet feeding.

The image forming device according to another aspect of the present disclosure is provided with the aforedescribed sheet feeding device, and a transfer section. The transfer section transfers a toner image to a sheet fed by the sheet feeding device. The first feed roller and the second feed roller constitute a resist roller pair situated upstream side of the transfer section in the sheet feed direction.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

An embodiment of the present disclosure will be described below, taking the example of a tandem system color laser printer.

Figure 1:
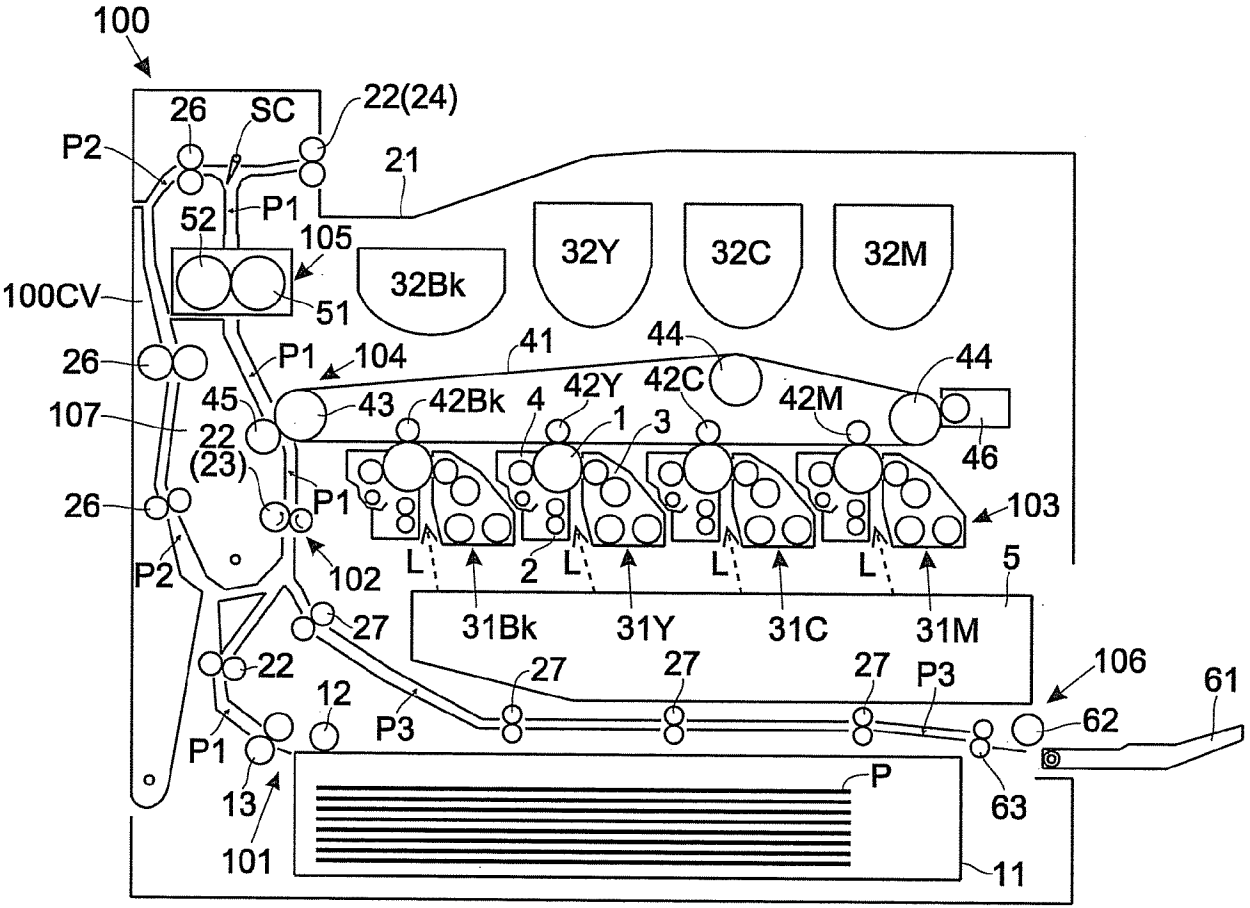
FIG. 1 is a schematic diagram of an image forming device (sheet feeding device) according to an embodiment of the present disclosure.

As shown in FIG. 1, an image forming device 100 of the present embodiment feeds paper P (corresponding to the "sheet" of the present disclosure), while printing an image onto the paper P. That is, a sheet feeding device for feeding the paper P is built into the image forming device 100.

Specifically, the image forming device 100 is provided with a paper supply section 101, a paper feed section 102, an image forming section 103, an intermediate transfer section 104, a fixing section 105, and a manual-feed paper supply section 106. As paper feed paths for feeding the paper P, the image forming device 100 has a first feed path P1, a second feed path P2, and a third feed path P3. Of these, the first feed path P1 corresponds to the "sheet feed path" of the present disclosure. The second feed path P2 is a reversal feed path for reversing the paper P front to back during duplex printing. The third feed path P3 is a manual-feed path for feed of manually-fed paper P.

The paper supply section 101 includes a paper cassette 11 into which the paper P is loaded. The paper supply section 101 supplies the first feed path P1 with the paper P loaded in the paper cassette 11. This paper supply section 101 is furnished with a pickup roller 12 for withdrawing the paper P loaded in the paper cassette 11. The paper supply section 101 is additionally furnished with a paper supply roller pair 13, whereby the paper P withdrawn from the paper cassette 11 is separated into single sheets and supplied to the first feed path P1.

The paper P supplied onto the first feed path P1 is fed by the paper feed section 102 through a transfer nip and a fixation nip, in this order, then discharged into a discharge tray 21. This paper feed section 102 includes a plurality of feed roller pairs 22 for feeding the paper along the first feed path P1. The feed roller pair 22 that, of the plurality of feed roller pairs 22, is the pair just to the front of the transfer nip, idles the paper P short of the transfer nip, then delivers it to the transfer nip in synchronized fashion to the timing of toner image formation and transfer. In the following description, this feed roller pair 22 is sometimes designated as a resist roller pair 23. The feed roller pair 22 that, of the plurality of feed roller pairs 22, is the pair closest to the discharge tray 21 rotates in reverse during duplex printing, and guides the paper P to the second feed path P2. In the following description, this feed roller pair 22 is sometimes designated as a discharge roller pair 24.

Figure 2:
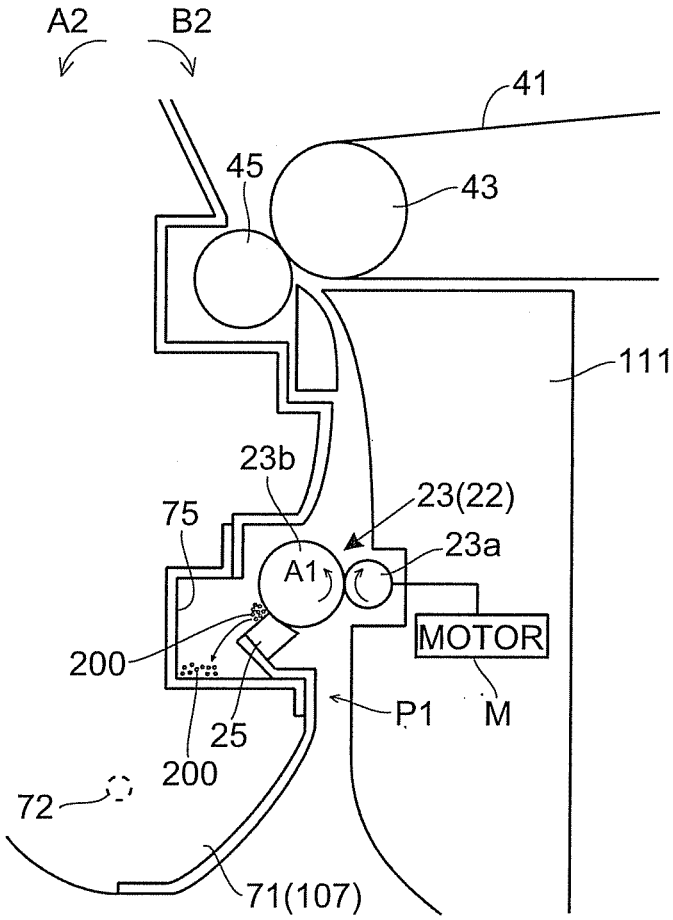
FIG. 2 is an enlarged view of the vicinity of a feed roller abutting a cleaning member of the image forming device shown in FIG. 1.

As shown in FIG. 2, the resist roller pair 23 is composed of resist rollers 23*a* and 23*b*. The resist roller 23*a* is a driving roller, and rotates through drive power transmitted from a motor M (corresponding to the "drive section"). The resist roller 23*b* is a driven roller which is pressed against the resist roller 23*a* to form a feed nip for feeding the paper P, and is rotated through driving by the resist roller 23*a* (while rotating in the direction A1 opposite the direction of rotation of the resist roller 23*a*). Formation of the feed nip constitutes a condition in which paper feed (printing) is enabled, with the paper P being fed by the resist roller pair 23 as the paper P advances through the feed nip.

The resist roller 23*a* is rotatably supported on a fixed frame 111 constituting the frame of the device chassis, while the resist roller 23*b* is rotatably supported on a turning frame 71 constituting the frame of a feed unit 107, discussed later. The turning frame 71 refers to a frame which is attached to the fixed frame 111 so as to be capable of turning (opening/closing) in a direction A2 (the same direction as the rotation direction of the resist roller 23*b* during paper feed) and in the direction B2 opposite the direction A2, about a turning shaft 72 as the turning fulcrum.

A cleaning member 25 for cleaning the resist roller 23*b* is furnished in the vicinity of the resist roller 23*b*. The cleaning member 25 is an elastically deformable member composed of a foamed member of sponge or the like, or of a blade made of resin, which is always in constant abutment against the resist roller 23*b*. In so doing, as the resist roller 23*b* rotates, foreign matter 200 such as paper dust or the like deposited on the resist roller 23*b* is scraped off by the cleaning member 25. That is, cleaning of the resist roller 23*b* is performed during paper feed (during printing), when the resist roller 23*b* is rotating in direction A1. A portion of the foreign matter 200 accumulates in a depression formed in the abutting portion of the cleaning member 25 and the resist roller 23*b*. The depression in which the foreign matter 200 gathers is formed through elastic deformation of the abutting portion of the cleaning member 25 that abuts the resist roller 23*b*. In this configuration, the resist roller 23*b* corresponds to the "second feed roller" of the present disclosure. That is, the resist roller 23*a* corresponds to the "first feed roller" of the present disclosure.

The foreign matter 200 scraped off by the cleaning member 25 drops into a recess 75, discussed later, where it accumulates, but in some cases remains accumulated in the abutting section (depression) of the resist roller 23*b* and the cleaning member 25, without dropping into the recess 75.

Returning to FIG. 1, the paper feed section 102 includes a plurality of reversal roller pairs 26 for feeding the paper P along the second feed path P2. The paper feed section 102 further includes a plurality of manual-feed roller pairs 27 for feeding the paper P along the third feed path P3.

The image forming section 103 includes toner image forming sections 31Bk, 31Y, 31C, and 31M (hereinafter, in some cases designated collectively simply as toner image forming sections 31) for forming toner images of the colors black, yellow, cyan, and magenta. The toner image forming sections 31 each have a photosensitive drum 1, an electrostatic device 2, a developing device 3, and a drum cleaning device 4. The image forming section 103 additionally has an exposure device 5 for emitting exposure light L to form an electrostatic image on the surface of the photosensitive drum 1. Toners of the colors black, yellow, cyan, and magenta are respectively contained in toner containers 32Bk, 32Y, 32C, and 32M.

The intermediate transfer section 104 includes an endless intermediate transfer belt 41. To the inside of the intermediate transfer belt 41 are situated primary transfer rollers 42Bk, 42Y, 42C, and 42M (hereinafter, in some cases designated collectively simply as primary transfer rollers 42) corresponding to the colors black, yellow, cyan, and magenta, which sandwich the intermediate transfer belt 41 in relation to the photosensitive drum 1 of the corresponding color. To the inside of the intermediate transfer belt 41 are situated a drive roller 43 and a driven roller 44, which, together with the primary transfer rollers 42, are spanned by the intermediate transfer belt 41. A secondary transfer roller 45 is situated sandwiching the intermediate transfer belt 41 in relation to the drive roller 43. In so doing, a transfer nip is formed by the intermediate transfer belt 41 and the secondary transfer roller 45.

Through application of transfer voltage to the primary transfer rollers 42, the toner images of each color formed by the image forming section 103 (the toner images on the surfaces of the photosensitive drums 1) undergo primary transfer in succession to the intermediate transfer belt 41, in superimposed fashion free from misalignment. Thereafter, through application of transfer voltage to the secondary transfer roller 45, the toner images produced by primary transfer to the intermediate transfer belt 41 undergo secondary transfer to the paper P. After the secondary transfer, cleaning of the intermediate transfer belt 41 is performed by a belt cleaning device 46.

The fixing section 105 applies heat and pressure to fix the toner image transferred to the paper P. This fixing section 105 includes a heated roller 51 and a pressure roller 52. The heated roller 51 incorporates a heat source. The pressure roller 52 is pressed against the heated roller 51, forming a fixing nip together with the heating roller 51. The paper P to which the toner image has been transferred is then subjected to heat and pressure by being passed through the fixing nip. In so doing, the toner image is fixed onto the paper P, completing printing. The printed paper P is sent to the discharge tray 21 by the discharge roller pair 24. However, when duplex printing is performed, the paper P having passed through the fixing nip (the paper P printed on one side) is sent to the second feed path P2.

In the case of performing duplex printing, a switching claw SC blocks the entrance of advance into the second feed path P2, so that the paper P sent from the fixing section 105 (the paper P printed on one side) does not advance to the second feed path P2. In so doing, the paper P sent from the fixing section 105 is guided into the discharge tray 21. At this time, the discharge roller pair 24 initially undergo forward rotation to partially discharge the paper P into the discharge tray 21, then undergo reverse rotation before the trailing edge of the paper P pass through. The switching claw SC opens the entrance of advance into the second feed path P2. In so doing, the paper P printed on one side is guided from the trailing edge thereof into the second feed path P2. Thereafter, the paper P printed on one side is fed along the second feed path P2 by the reversal roller pair 26, reaching the upstream side in the paper feed direction from the resist roller pair 24 (and is supplied to the first feed path P1). At this time, because the paper P has been reversed front to back, printing is performed on the back face (unprinted face) of the paper P.

The manual-feed paper supply section 106 includes a manual-feed tray 61. The manual-feed tray 61 is attached in turnable (opening/closing) fashion with respect to the device chassis. In so doing, the manual-feed tray 61 can be stowed away when the manual-feed tray 61 is not used (see FIG. 3).

The manual-feed paper supply section 106 supplies the paper P placed on the manual-feed tray 61 to the third feed path P3. The manual-feed paper supply section 106 is furnished with a pickup roller 62 for withdrawing the paper P placed on the manual-feed tray 61. The manual-feed paper supply section 106 is additionally furnished with a paper supply roller pair 63 whereby the paper P withdrawn from the manual-feed tray 61 is separated into single sheets and supplied to the third feed path P3. In so doing, the paper P supplied to the third feed path P3, fed by the manual-feed roller pairs 27, reaches the resist roller pair 23 (and is supplied to the first feed path P1).

Figure 3:
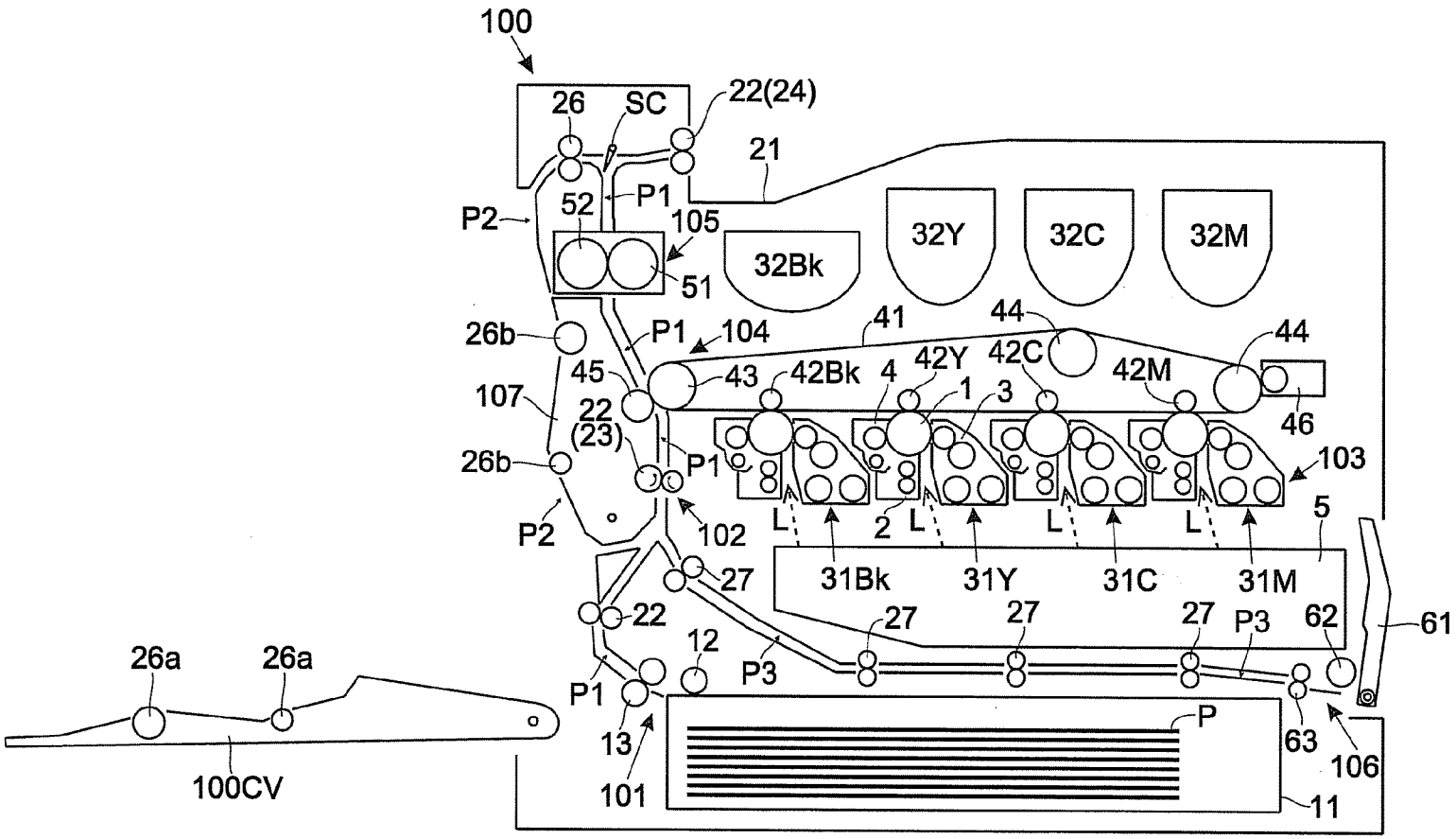
FIG. 3 is a view of the image forming device shown in FIG. 1, with the device cover open.

As shown in FIG. 1 and FIG. 3, a wall portion positioned to the second feed path P2 side of the image forming device 100 is constituted by a device cover 100CV attached in turnable (opening/closing) fashion with respect to the device chassis. This device cover 100CV holds a reversal roller 26*a*, which is one of reversal rollers 26*a* and 26*b* that constitute the reversal roller pair 26. The device cover 100CV is closed during paper feed (during printing) (the state shown in FIG. 1). On the other hand, when the device cover 100CV is open (the state shown in FIG. 3), the second feed path P2 is exposed (the feed unit 107, discussed later, is exposed). Consequently, in cases in which a paper jam has occurred on the second feed path P2, the device cover 100CV can be opened in order to easily perform a jam treatment procedure to clear the jam. Paper feed (printing) is not performed with the device cover 100CV open.

Figure 4:
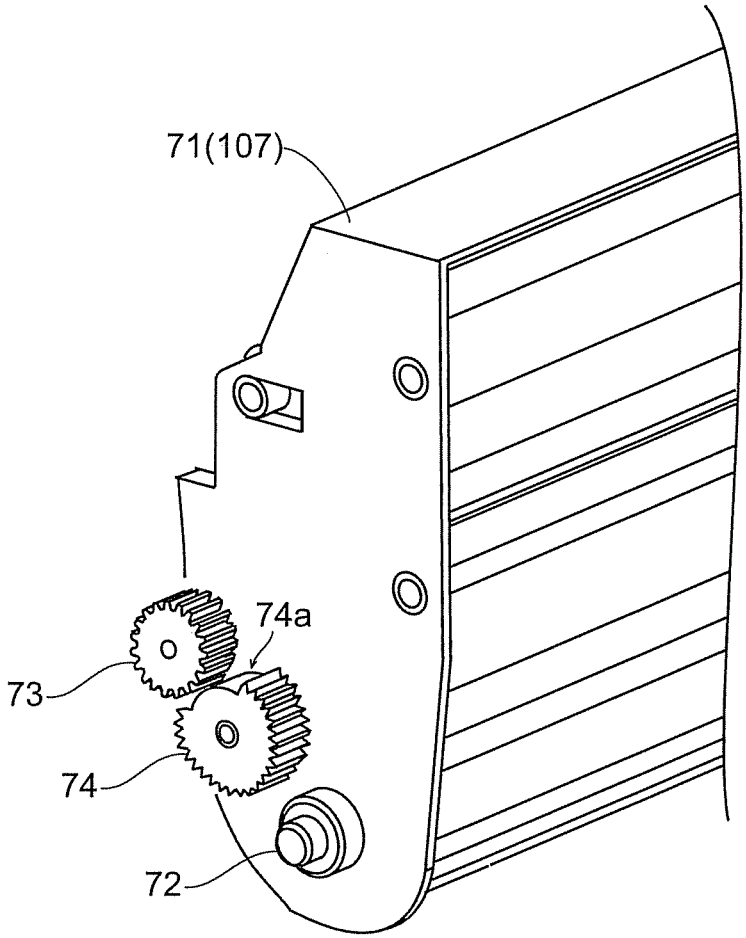
FIG. 4 is a perspective view (fragmentary perspective view of a turning frame) of a feed gear and a transmission gear for rotating the feed roller abutting the cleaning member of the image forming device shown in FIG. 1, in the opposite direction from that during sheet feeding.

As shown in FIG. 3, the feed unit 107 which is exposed by opening the device cover 100CV is a unit constituted inter alia by the reversal roller 26*b*, the resist roller 23*b*, the cleaning member 25, and the secondary transfer roller 45. Specifically, as shown in FIG. 4, the members constituting the feed unit 107 (the reversal roller 26*b*, the resist roller 23*b*, the cleaning member 25, the secondary transfer roller 45, and so on) are attached to the turning frame 71, and constituted as a unit thereby. The reversal roller 26*b*, the resist roller 23*b*, and the secondary transfer roller 45 are rotatably supported by the turning frame 71.

The turning frame 71 has the turning shaft 72 situated at one end thereof. This turning shaft 72 is supported by fitting into mating holes 112 (see FIG. 5) furnished to the fixed frame 111. In so doing, as shown in FIG. 2, the turning frame 71 is turnable (opening/closing) in the direction A2 (the same direction as the rotation direction of the resist roller 23*b* during paper feed) and in the direction B2 opposite the direction A2, about the turning shaft 72 as the turning fulcrum. That is, the feed unit 107 is turnable in the direction A2 and the direction B2. In the following description, the turn position of the feed unit 107 when the feed unit 107 has not been turned in the direction A2 is designated as the closed position. The limit position for turning of the feed unit 107 towards the direction A2 is, for example, a position turned by approximately 90° from the closed position in the direction A2. In the following description, the turning position of the feed unit 107 when the feed unit 107 has been turned by approximately 90° in the direction A2 is designated as the open position.

With the feed unit 107 held in the closed position, the resist roller 23*b* presses against the resist roller 23*a*, forming the feed nip, while the secondary transfer roller 45 presses against the intermediate transfer belt 41, forming the transfer nip (the state in FIG. 2). The first feed path P1 is then formed by the turning frame 71 and the fixed frame 111. That is, the closed position refers to the position at which paper feed is possible.

Figure 8:
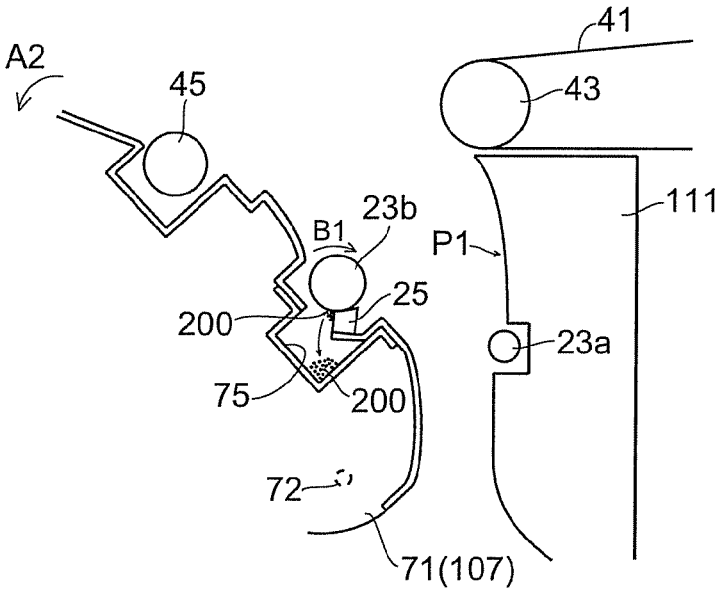
FIG. 8 is a state diagram of the vicinity of the feed roller abutting the cleaning member when the turning frame is turned towards the closed position from the state in FIG. 6.
Figure 10:
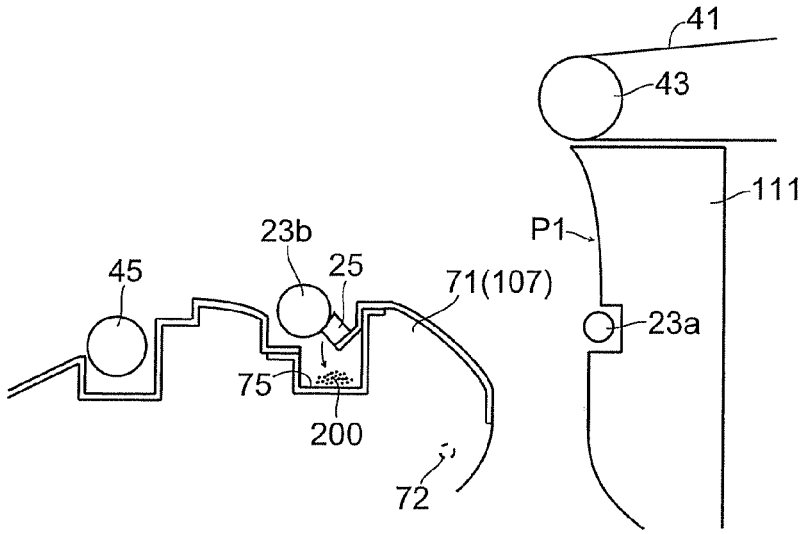
FIG. 10 is a state diagram of the vicinity of the feed roller abutting the cleaning member when the turning frame is turned towards the open position from the state in FIG. 6.

When the feed unit 107 is turned from the closed position to the open position, the resist roller 23*b* separates from the resist roller 23*a*, and the secondary transfer roller 45 separates from the intermediate transfer belt 41 (the state in FIG. 8 and FIG. 10). The inside of the first feed path P1 is then exposed. Consequently, in cases in which a paper jam has occurred on the first feed path P1, a jam treatment procedure to clear the jam can be performed easily, by turning the feed unit 107 from the closed position to the open position.

Figure 5:
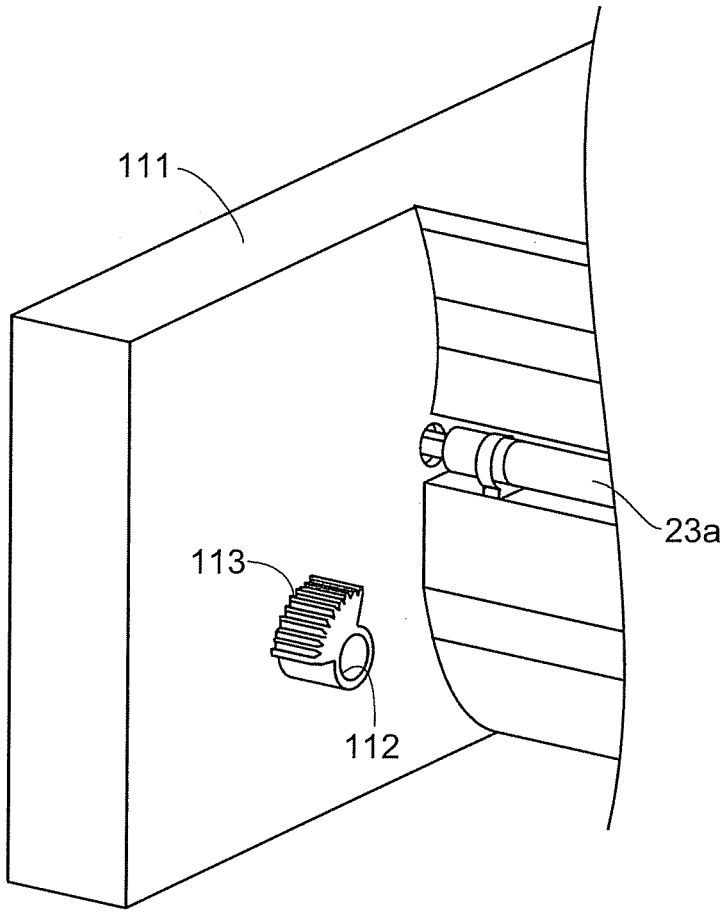
FIG. 5 is a perspective view (fragmentary perspective view of a fixed frame) of a fixed gear for rotating the feed roller abutting the cleaning member of the image forming device shown in FIG. 1, in the opposite direction from that during sheet feeding.

As shown in FIG. 5, a gear-forming part 113 having the mating hole 112 as the gear center is fixed in non-rotating state on the fixed frame 111. This gear-forming part 113 is a sector gear having a plurality of gear teeth arrayed along part of a circle (an arc) centered on the mating hole 112 (the turning fulcrum of the turning frame 71). The gear-forming part 113 may also be, for example, one having a plurality of gear teeth arrayed along the entire circumference of a circle centered on the mating hole 112. Where the fixed frame 111 is made of resin, the gear-forming part 113 may be integrally molded with the fixed frame 111, in order to reduce the number of parts. The gear-forming part 113 corresponds to the "fixed gear" of the present disclosure.

As shown in FIG. 4, a resist gear 73 that rotates in unison together with the resist roller 23*b* in the same direction as the resist roller 23*b* is rotatably supported by the turning frame 71. This resist gear 73 is furnished to an end part of the rotation shaft of the resist roller 23*b*. The resist gear 73 corresponds to the "feed gear" of the present disclosure.

An incompletely-toothed gear 74 having a missing portion 74*a* from which gear teeth are missing is also rotatably supported by the turning frame 71. This incompletely-toothed gear 74 is situated between the resist gear 73 and the gear-forming part 113, in such a way as to constantly mesh with the gear-forming part 113 when the turning frame 71 is turnably supported on the fixed frame 111. The incompletely-toothed gear 74 corresponds to the "transmission gear" of the present disclosure.

Figure 6:
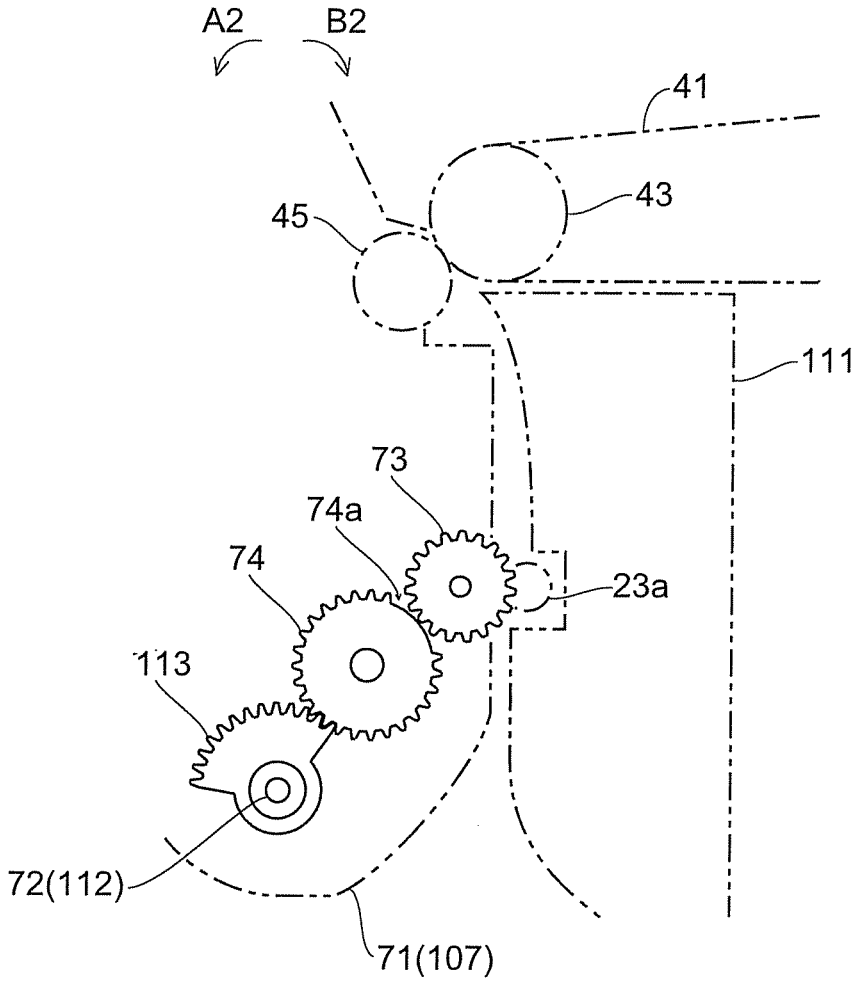
FIG. 6 is a state diagram of a gear train (the feed gear, transmission gear, and fixed gear) when the turning frame of the image forming device shown in FIG. 1 is held at the closed position.

As shown in FIG. 6, with the feed unit 107 (the turning frame 71) held in the closed position, the gear-forming part 113 meshes with (engages) the incompletely-toothed gear 74. On the other hand, the resist gear 73, by virtue of facing the missing portion 74*a,* does not mesh with (does not engage) the incompletely-toothed gear 74. In so doing, rotation of the resist roller 23*b* in the direction A1 during paper feed is unimpaired. That is, during paper feed, as shown in FIG. 2, the resist roller 23*b,* driven by the resist roller 23*a,* rotates in the direction A1. Through rotation of the resist roller 23*b* in the direction A1, foreign matter D deposited onto the resist roller 23*b* is scraped off by the cleaning member 25. The foreign matter 200 then drops into and accumulates in the recess 75, discussed later. Alternatively, the foreign matter may accumulate in the contacting section (depression) of the resist roller 23*b* and the cleaning member 25, without dropping into the recess 75.

Figure 7:
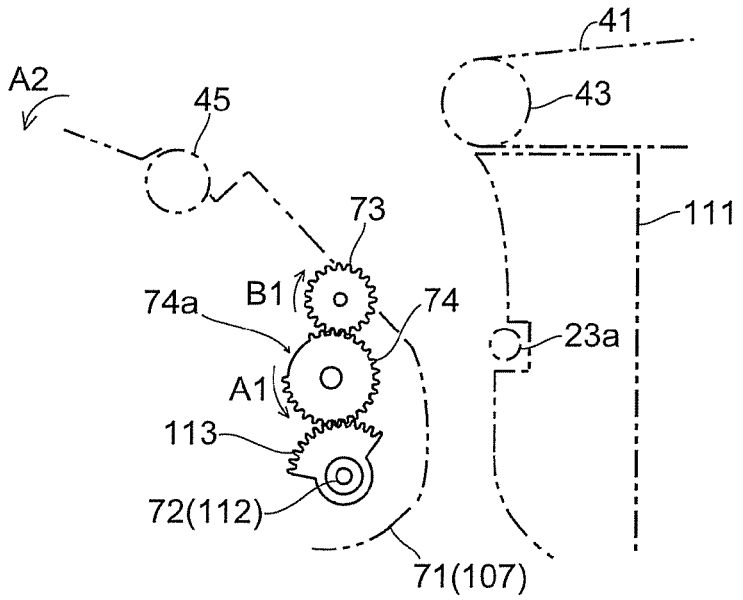
FIG. 7 is a state diagram of the gear train (the feed gear, transmission gear, and fixed gear) when the turning frame is turned towards the open position from the state in FIG. 6.
Figure 9:
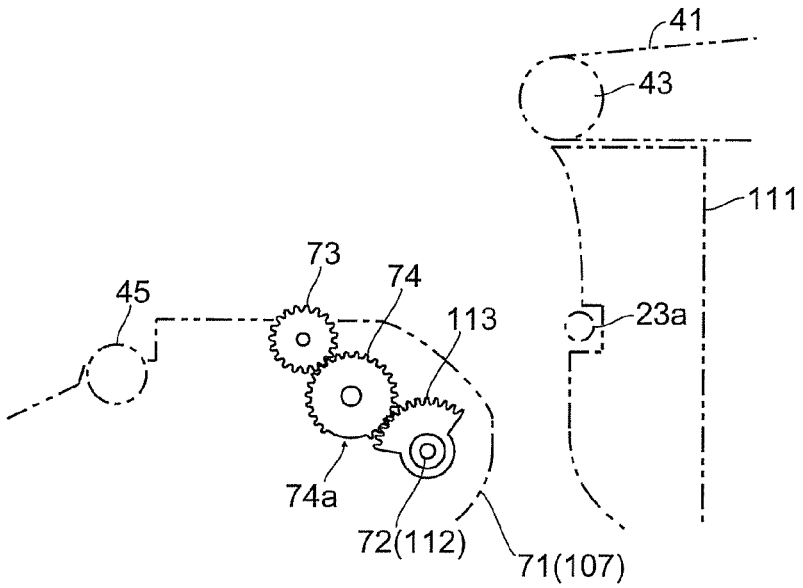
FIG. 9 is a state diagram of the gear train (the feed gear, transmission gear, and fixed gear) when the turning frame is turned towards the open position from the state in FIG. 6.

On the other hand, as shown in FIG. 7, when the feed unit 107 (the turning frame 71) is turned from the closed position towards the open position, the resist gear 73 and the incompletely-toothed gear 74, together with the turning frame 71, turn about the turning shaft 72 as the turning fulcrum. The incompletely-toothed gear 74 constantly meshes with the gear-forming part 113. The gear-forming part 113 is fixed in non-rotating state to the fixed frame 111. Consequently, as the feed unit 107 (the turning frame 71) turns from the closed position towards the open position, the incompletely-toothed gear 74, due to meshing thereof with the gear-forming part 113, rotates in the direction A1 (the position of the missing portion 74*a* with respect to the resist gear 73 shifts in the direction A1). As the feed unit 107 continues to turn from the closed position towards the open position, the resist gear 73 meshes with (engages) the incompletely-toothed gear 74 rotating in the direction A1. In so doing, the resist gear 73 begins to rotate in the direction B1. In so doing, as shown in FIG. 8, the resist roller 23*b* rotates in the direction B1 together with the resist gear 73. Then, as the feed unit 107 (the turning frame 71) turns from the closed position towards the open position, the state shown in FIG. 9 and FIG. 10 is produced.

As shown in FIG. 8 and FIG. 10, as the feed unit 107 (the turning frame 71) turns from the closed position towards the open position, the contacting section (depression) of the resist roller 23*b* and the cleaning member 25, where the foreign matter 200 has accumulated, gradually heads downward. At this time, the resist roller 23*b* is rotating in the direction B1. In so doing, the foreign matter 200 accumulated in the contacting section of the resist roller 23*b* and the cleaning member 25 is scraped away by the resist roller 23*b* rotating in the direction B1, and falls downward.

Figure 11:
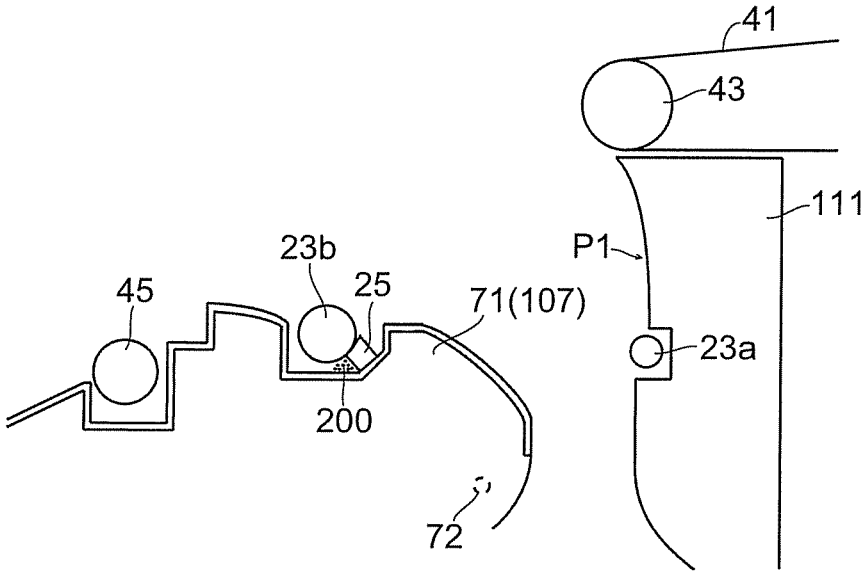
FIG. 11 is a diagram of a case in which a recess is omitted from the turning frame shown in FIG. 10.

However, as shown in FIG. 11, when for example a portion of the turning frame 71 approaches the contacting section of the resist roller 23*b* and the cleaning member 25, the foreign matter 200 accumulated in the contacting section (depression) of the resist roller 23*b* and the cleaning member 25 cannot fall downward. For this reason, the turning frame 71 has been furnished with the recess 75 for the purpose of receiving the falling foreign matter 200 accumulated in the contacting section of the resist roller 23*b* and the cleaning member 25, when the turning frame 71 has turned from the closed position towards the open position as shown in FIG. 8 and FIG. 10. The recess 75 is designed such that the opening of the recess 75 is situated below the cleaning member 25 when the turning frame 71 has turned from the closed position to the open position. The recess 75 is constructed in such a way that foreign matter having accumulated in the recess 75 does not spill out when the turning frame 71 is held at the closed position.

As described above, the image forming device 100 (sheet feeding device) of the present embodiment is provided with the fixed frame 111 having the motor M (drive section) and the resist roller 23*b* (first feed roller); and with the turning frame 71 which is supported in opening/closing fashion at one end thereof as the turning fulcrum by the fixed frame 111, and which at the closed position forms the first feed path P1 (sheet feed path) in association with the fixed frame 111, the inside of the first feed path P1 being exposed through turning thereof from the closed position to an open position. The turning frame 71 includes the resist roller 23*b* (second feed roller) which includes the integrally rotatable resist gear 73 (feed gear), and which at the closed position forms a nip together with the resist roller 23*a* at the closed position, and feeds the paper P (sheet) through rotation thereof; the cleaning member 25 which wipes against the peripheral surface of the resist roller 23*b;* and the rotatably supported, incompletely-toothed gear 74 (transmission gear) capable of engaging and disengaging the resist gear 73. The fixed frame 111 includes the gear-forming part 113 (fixed gear) which is fixed to the fixed frame 111, and which through turning of the turning frame 71 from the closed position to the open position engages the incompletely-toothed gear 74 and rotates the incompletely-toothed gear 74. The incompletely-toothed gear 74 disengages from the resist gear 73 when the turning frame 71 is at the closed position, and through turning of the turning frame 71 from the closed position to the open position, rotates to engage the resist gear 73, rotating the resist roller 23*b* in the opposite direction from that during sheet feeding.

According to the configuration of the present embodiment, the inside of the first feed path P1 is exposed through turning of the turning frame 71 from the closed position (the position of forming the first feed path P1 in association with the fixed frame 111) to the open position. Consequently, when a paper jam has occurred on the first feed path P1, the turning frame 71 is turned from the closed position towards the open position, in order to perform a jam treatment procedure to clear the jam on the first feed path P1. At this time, in association with turning of the turning frame 71 from the closed position towards the open position, the resist roller 23*b* rotates in the direction B1 which is the opposite of the direction A1 (the direction of rotation during feeding of the paper P to the downstream side). Therefore, despite the foreign matter 200 scraped off by the cleaning member 25 as the resist roller 23*b* rotates in the direction A1 having accumulated in the contacting section of the resist roller 23*b* and the cleaning member 25, the foreign matter 200 is scraped away by the resist roller 23*b* rotating in the direction B1.

In so doing, when the turning frame 71 is turned from the closed position to the open position in order to perform a jam treatment procedure, the foreign matter 200 accumulated in the contacting section of the resist roller 23*b* and the cleaning member 25 is removed. Consequently, the need for a special procedure in order to remove the foreign matter 200 accumulated in the contacting section of the resist roller 23*b* and the cleaning member 25 is obviated. When the jam treatment procedure is performed (when the turning frame 71 is turned from the closed position to the open position), the foreign matter 200 accumulated in the contacting section of the resist roller 23*b* and the cleaning member 25 is removed, and therefore situations in which the foreign matter 200 accumulated in the contacting section of the resist roller 23*b* and the cleaning member 25 is left there can be avoided.

The resist roller 23*b* is a feed roller situated to the upstream side in the paper feed direction from the transfer nip, the feed roller contacting the fed paper P at a point just before reaching the transfer nip. Consequently, by cleaning the resist roller 23*b* with the cleaning member 25 and removing the foreign matter 200 accumulated in the contacting section of the resist roller 23*b* and the cleaning member 25, situations in which the foreign matter 200 is fed through the transfer nip together with the paper P and becomes deposited on the secondary transfer roller 45 can be avoided. In so doing, diminished image quality caused by deposition of the foreign matter 200 on the secondary transfer roller 45 can be minimized.

Moreover, in the present embodiment, in the aforedescribed manner, the turning frame 71 is provided with the recess 75 for the purpose of receiving the falling foreign matter 200 scraped off by the cleaning member 25 (the foreign matter 200 accumulated in the contacting section of the resist roller 23*b* and the cleaning member 25) when the turning frame 71 is turned from the closed position to the open position. According to this configuration, when the turning frame 71 has turned from the closed position to the open position, the foreign matter 200 accumulated in the contacting section of the resist roller 23*b* and the cleaning member 25 will fall, whereby the foreign matter 200 accumulated in the contacting section of the resist roller 23*b* and the cleaning member 25 can easily be removed. Moreover, because the foreign matter 200 falling from the contacting section of the resist roller 23*b* and the cleaning member 25 is received in the recess 75, the foreign matter 200 does not scatter about the surrounding area.

Additionally, according to the present embodiment, in the aforedescribed manner, the recess 75 is furnished to the turning frame 71 in such a way that the opening of the recess 75 is situated below the cleaning member 25 when the turning frame 71 is turned from the closed position to the open position. According to this configuration, the foreign matter 200 can be made to fall into the recess 75 in a reliable manner, when the turning frame 71 is turned from the closed position to the open position.

Additionally, according to the present embodiment, in the aforedescribed manner, the fixed frame 111 is made of resin. The gear-forming part 113 is integrally molded with the fixed frame 111. According to this configuration, an increase in the number of parts can be avoided.

The embodiments disclosed herein are in all respects merely exemplary, and should not be construed as limiting. The scope of the present disclosure is shown by the claims and not by the foregoing description of the embodiments, and all modifications equivalent in significance within the scope of the claims are encompassed therein.

What is claimed is:

1. A sheet feeding device comprising:

a fixed frame having a drive section and a first feed roller; and a turning frame which is supported in opening/closing fashion at one end thereof as a turning fulcrum by the fixed frame, and which at a closed position forms a sheet feed path in association with the fixed frame, the turning frame exposes the inside of the sheet feed path by turning from the closed position to an open position, wherein the turning frame includes:

a second feed roller with an integrally rotatable feed gear which at the closed position forms a nip together with the first feed roller, and rotates to feed a sheet;

a cleaning member configured to wipe the peripheral surface of the second feed roller; and a rotatably supported transmission gear capable of engaging and disengaging the feed gear, the fixed frame includes a fixed gear which is fixed to the fixed frame, and which through turning of the turning frame from the closed position to the open position engages the transmission gear and rotates the transmission gear, and wherein the transmission gear is disengaged from the feed gear when the turning frame is at the closed position, and through turning of the turning frame from the closed position to the open position, it is engaged the feed gear, and makes the second feed roller rotate in the opposite direction from that during sheet feeding.

2. The sheet feeding device according to claim 1, wherein the transmission gear has a missing portion from which gear teeth are missing; and the transmission gear, when the turning frame is at the closed position, fails to engage the feed gear by virtue of the fact that the missing portion faces the feed gear; and rotates to engage the feed gear through turning of the turning frame from the closed position to the open position.

3. The sheet feeding device according to claim 1, wherein the fixed gear is fixed in non-rotating state; and the transmission gear constantly engages the fixed gear as the turning frame turns from the closed position towards the open position.

4. The sheet feeding device according to claim 1, wherein the cleaning member scrapes off foreign matter deposited on the second feed roller through rotation of the second feed roller; and the turning frame is provided with a recess for receiving the falling foreign matter scraped off by the cleaning member, when the turning frame turns from the closed position to the open position.

5. The sheet feeding device according to claim 4, wherein the recess is furnished to the turning frame in such a way that the opening of the recess is situated below the cleaning member, when the turning frame has been turned to the open position.

6. The sheet feeding device according to claim 5, wherein the foreign matter accumulates between the second feed roller and the cleaning member; and the foreign matter falls into the recess, when the turning frame has been turned to the open position.

7. The sheet feeding device according to claim 1, wherein the fixed frame is made of resin; and the fixed gear is integrally molded with the fixed frame.

8. The sheet feeding device according to claim 1, wherein the first feed roller is a drive roller engaged by the drive section and driven to rotate thereby; and the second feed roller is a driven roller driven to rotate by the first feed roller.

9. The sheet feeding device according to claim 6, wherein the cleaning member is elastically deformable, and is deformed in a section thereof contacting the second feed roller, to form a depression in which the foreign matter gathers.

10. An image forming device comprising:

the sheet feeding device according to claim 1; and an image forming section for forming the image on the sheet fed by the sheet feeding device, wherein the first feed roller and the second feed roller constitutes a resist roller pair situated upstream side of the image forming section in a sheet feed direction.

* * * * *